US005924372A

United States Patent [19]

Okuda et al.

[11] Patent Number: 5,924,372

[45] Date of Patent: Jul. 20, 1999

[54] EMBROIDERY DATA PROCESSING DEVICE FOR SEWING MACHINE INCLUDING MEANS FOR LIMITING REPEATED USE OF EMBROIDERY DATA

[75] Inventors: Seijiro Okuda, Nagoya; Nami Morita, Aichi-ken; Akira Hayakawa, Nagoya, all of Japan

[73] Assignee: Brother Kogyo Kabushiki Kaisha, Nagoya, Japan

[21] Appl. No.: 09/036,957

[22] Filed: Mar. 9, 1998

[30] Foreign Application Priority Data

Mar. 11, 1997 [JP] Japan ..... 9-056321

[51] Int. Cl.[6] ..... D05C 5/02; D05B 21/00

[52] U.S. Cl. ..... 112/102.5; 112/445; 112/470.02; 364/470.09

[58] Field of Search ..... 112/102.5, 470.06, 112/456, 445, 475.19, 470.02, 470.04; 364/470.09

[56] References Cited

U.S. PATENT DOCUMENTS

| | | | |
|---|---|---|---|
| 5,791,270 | 8/1998 | Mori | 112/102.5 |
| 5,826,526 | 10/1998 | Tomita | 112/102.5 |
| 5,865,134 | 2/1999 | Okuyama et al. | 112/102.5 |

FOREIGN PATENT DOCUMENTS

A 8-299632 11/1996 Japan .

*Primary Examiner*—Peter Nerbun
*Attorney, Agent, or Firm*—Oliff & Berridge, PLC

[57] ABSTRACT

In an embroidery data processing device for a sewing machine, a ROM stores embroidery data of a number of embroidery patterns and sewing data of ordinary sewing modes. An external ROM card stores embroidery data of character patterns each protected by copyright. A user selects a desired embroidery pattern on a screen of an LCD so that a sewing operation is executed on the basis of the embroidery data of the selected embroidery pattern. Upon completion of the sewing operation, a control device judges whether the embroidery pattern is a character pattern. When the embroidery pattern is a character pattern, the number of times of sewing with respect to the embroidery pattern is counted and data of the counted number of times is stored in a non-volatile memory. The counted number of times of sewing is further compared with a limited number of times. When the counted number of times of sewing is equal to or larger than the limited number of times, the control device judges that the character pattern is unfairly used for business purposes or commercial purposes. Selection of the character pattern judged to be unfairly used is prohibited when it is subsequently selected.

22 Claims, 12 Drawing Sheets

| |
|---|
| CHARACTER ATTRIBUTES OF FIRST EMBROIDERY PATTERN |
| CHARACTER ATTRIBUTES OF SECOND EMBROIDERY PATTERN |
| CHARACTER ATTRIBUTES OF THIRD EMBROIDERY PATTERN |
| CHARACTER ATTRIBUTES OF FOURTH EMBROIDERY PATTERN |
| ⋮ |
| ⋮ |
| LIMITED NUMBER OF TIMES OF SEWING OF FIRST EMBROIDERY PATTERN |
| LIMITED NUMBER OF TIMES OF SEWING OF SECOND EMBROIDERY PATTERN |
| LIMITED NUMBER OF TIMES OF SEWING OF THIRD EMBROIDERY PATTERN |
| LIMITED NUMBER OF TIMES OF SEWING OF FIRST EMBROIDERY PATTERN |
| ⋮ |
| ⋮ |
| SEWING DATA OF FIRST EMBROIDERY PATTERN |
| SEWING DATA OF SECOND EMBROIDERY PATTERN |
| SEWING DATA OF THIRD EMBROIDERY PATTERN |
| SEWING DATA OF FOURTH EMBROIDERY PATTERN |
| ⋮ |
| ⋮ |
| DISPLAY DATA OF FIRST EMBROIDERY PATTERN |
| DISPLAY DATA OF SECOND EMBROIDERY PATTERN |
| DISPLAY DATA OF THIRD EMBROIDERY PATTERN |
| DISPLAY DATA OF FOURTH EMBROIDERY PATTERN |
| ⋮ |
| ⋮ |

26

FIG. 9

| |
|---|
| NUMBER OF TIMES OF SEWING OF FIRST EMBROIDERY PATTERN |
| NUMBER OF TIMES OF SEWING OF SECOND EMBROIDERY PATTERN |
| NUMBER OF TIMES OF SEWING OF THIRD EMBROIDERY PATTERN |
| NUMBER OF TIMES OF SEWING OF FOURTH EMBROIDERY PATTERN |
| • • |
| • • |

24

FIG. 10

EMBROIDERY DATA PROCESSING DEVICE FOR SEWING MACHINE INCLUDING MEANS FOR LIMITING REPEATED USE OF EMBROIDERY DATA

BACKGROUND OF THE INVENTION

1. Field of the Invention

This invention relates to an embroidery data processing device provided, for example, in a sewing machine, for processing embroidery data of a number of embroidery patterns including specified embroidery patterns such as character patterns.

2. Description of the Related Art

There has recently been provided a household embroidery machine storing data of a number of embroidery patterns such as pictures and letters. A desired one or more of the embroidery patterns are selected by a user so that the selected embroidery patterns are formed on a workpiece cloth. Embroidery data (sewing data) required for executing the above-described embroidery forming operation is stored in an internal memory such as ROM provided in the machine or an external memory medium such as an external memory card. Upon selection of a desired embroidery pattern by the user, the embroidery data corresponding to the selected embroidery pattern is read from the internal memory or external ROM card. An embroidery forming operation is executed on the basis of the read embroidery data.

The assignee of the present invention has supplied embroidery machines of the above-described type and recently, further supplied external memory cards called "embroidery cards" storing embroidery data corresponding to embroidery patterns such as various character patterns including characters in comics, animations, television programs, television games and movies, and images of robots, vehicles and logos with the consent of copyright owners. The users can enjoy embroidering character patterns at home. The term, "character," will hereinafter have the meaning as mentioned above throughout the description.

The above-mentioned embroidery data of the character patterns aims in principle at the users' enjoying embroidering at home for private purposes. No problem arises when embroideries of the character patterns formed with the above-described embroidery machine are privately used. On the other hand, making and merchandising a large number of embroideries of character patterns on the basis of the embroidery data constitutes an unfair business practice. However, the embroidering operation can be executed at a large number of times when the embroidery machine is supplied with the embroidery data (memory card). These circumstances are applied to overall devices for storing and processing the embroidery data as well as the embroidery machines.

SUMMARY OF THE INVENTION

Therefore, an object of the present invention is to provide a sewing data processing device which is provided with functions of processing embroidery data necessary for execution of the sewing operation and which can prevent an unfair use of the specified embroidery patterns such as character patterns.

The present invention provides an embroidery data processing device comprising storage means for storing embroidery data of one or more embroidery patterns used for execution of at least one sewing operation, the embroidery patterns including at least one specified embroidery pattern, processing means reading the embroidery data from the storage means for processing the read embroidery data, judging means for judging whether the embroidery data of the specified embroidery pattern has unfairly been used, and prohibiting means for prohibiting use of the embroidery data of the specified embroidery pattern for the sewing operation when the judging means judges that the embroidery data of the specified embroidery pattern has unfairly been used.

According to the above-described device, the prohibiting means prohibits the use of the embroidery data of the specified embroidery pattern for the sewing operation when the user unfairly uses the embroidery data of the specified embroidery pattern to merchandise the formed embroideries. In other words, only bona fide users using an embroidery formed on the basis of the embroidery data of the specified embroidery pattern for private purposes at home can use the embroidery data.

The prohibiting means preferably prohibits the embroidery data of the specified embroidery pattern from being read from the storage means. Consequently, the unfairly used embroidery data can reliably be prohibited from being used for the sewing operation.

The invention also provides an embroidery data processing device for an embroidery machine comprising storage means for storing embroidery data of one or more embroidery patterns used for execution of at least one sewing operation, the embroidery patterns including at least one specified embroidery pattern, processing means reading the embroidery data from the storage means for processing the read embroidery data, sewing control means for controlling the machine so that the sewing operation is executed on the basis of the embroidery data processed by the processing means, judging means for judging whether the embroidery data of the specified embroidery pattern has unfairly been used, and control means for controlling the machine so that at least one sewing operation differing from at least one normal sewing operation on the basis of the embroidery pattern of the specified embroidery pattern is executed, when the judging means judges that the embroidery data of the specified embroidery pattern has unfairly been used.

According to the above-described device, the sewing operation executed on the basis of the embroidery data judged to be unfairly used is compelled to result in a failure. Accordingly, the user cannot use the embroideries formed on the basis of the embroidery data of the specified embroidery pattern for the business purposes or commercial purposes. Furthermore, since the sewing operation is executed in vain, the productivity would be reduced.

In the case where the embroidery machine comprises a sewing needle and executes the sewing operation by moving a workpiece cloth relative to the sewing needle, the control means preferably controls the machine so that the workpiece cloth is moved in at least one manner differing from at least one normal manner when the judging means judges that the embroidery data of the specified embroidery pattern has unfairly been used.

The embroidery data processing device preferably further comprises informing means for informing of unfair use of the embroidery data of the specified embroidery pattern when the judging means judges that the embroidery data of the specified embroidery pattern has unfairly been used. Consequently, the user can reliably be informed of prohibition of unfair use of the specified embroidery pattern.

When the embroidery data of the specified embroidery pattern is used for the business purposes or commercial purposes, the number of times of use of the embroidery data would become larger than in the private use of the embroidery data. In view of this, the processing device preferably further comprises count means for counting the number of times of use of the embroidery data of the specified embroidery pattern. In this case, the judging means judges whether the embroidery data of the specified embroidery pattern has unfairly been used, on the basis of the number of times of use counted by the count means. Consequently, the judgment about the unfair use of the embroidery data can be realized by a simpler arrangement.

There is a possibility that the embroidery data of the specified embroidery pattern may erroneously be judged to be unfairly used even when the embroidery data is normally used. In view of this, the embroidery data processing device preferably further comprises canceling means for canceling the prohibition of the use of the embroidery data of the specified embroidery pattern for the sewing operation by the prohibiting means. Furthermore, the embroidery data processing device preferably further comprises return means for returning the operation differing from a normal sewing operation to the normal sewing operation.

BRIEF DESCRIPTION OF THE DRAWINGS

Other objects, features and advantages of the present invention will become clear upon reviewing the following description of preferred embodiments thereof, made with reference to the accompanying drawings, in which:

FIG. 9 shows data structure in an external ROM card;

FIG. 10 shows data structure in a non-volatile memory;

DETAILED DESCRIPTION OF THE PREFERRED EMBODIMENTS

Figure 1:
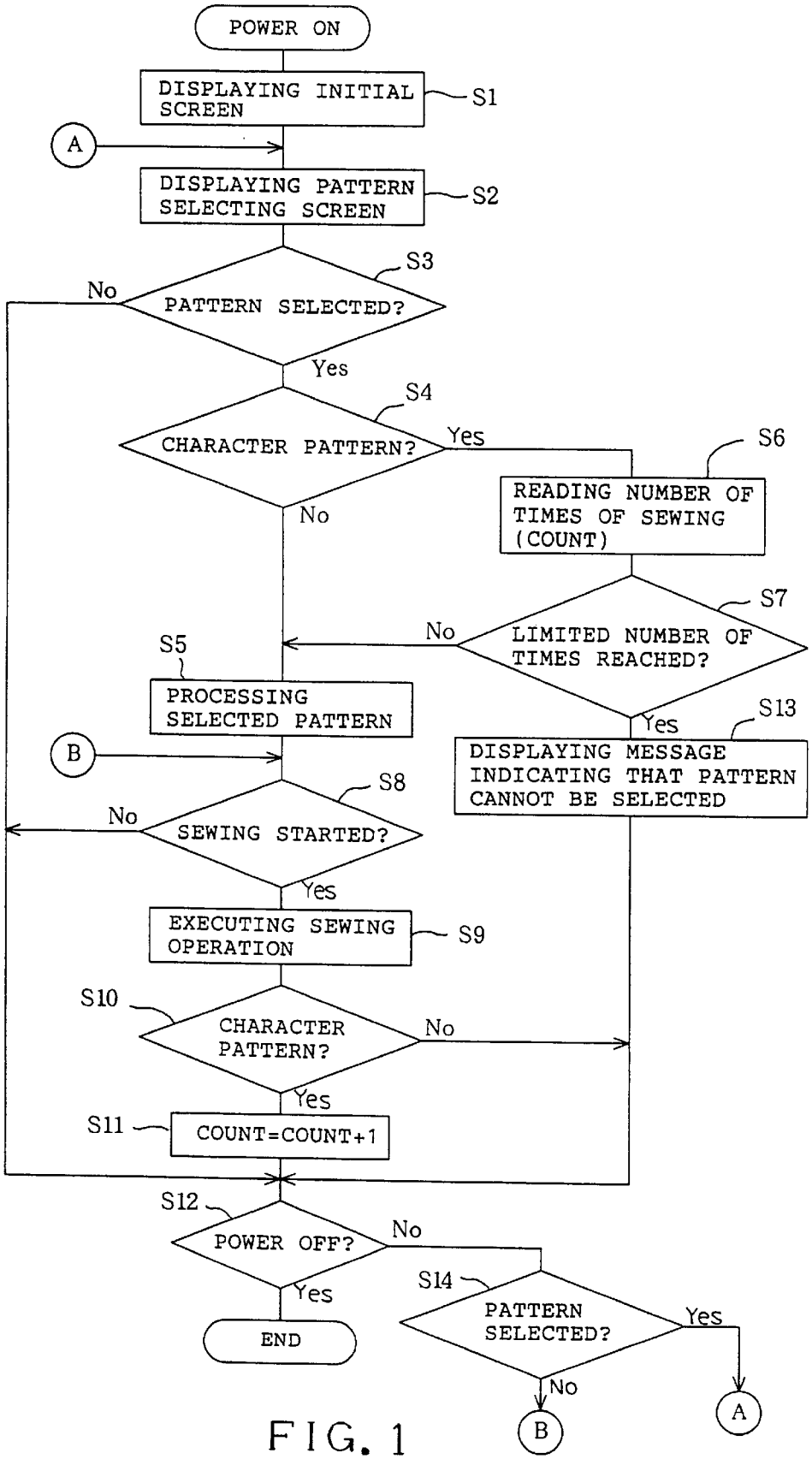
FIG. 1 is a flowchart showing processing procedures in the case of selection of an embroidery pattern and in the case of execution of the sewing operation in an embroidery machine of a first embodiment in accordance with the present invention.

A first embodiment will be described with reference to FIGS. 1 to 10. The present invention is applied to a household embroidery machine in the first embodiment. The embroidery machine has a function as a sewing data processing device. Referring first to FIG. 2, an overall embroidery machine is schematically shown. The embroidery machine comprises a main body 1 including a bed 2 and an arm 3 formed integrally with and extending over the bed 2. A needle bar 5 having a sewing needle 4 is provided on a distal end of the arm 3. The distal end of the arm 3 is also provided with a ring-shaped presser foot 6 through which the sewing needle 4 passes. The presser foot 6 applies a suitable force to a workpiece cloth (not shown) to bias a part of the workpiece cloth through which the needle 4 passes. A throat plate 2*a* is mounted on an upper surface of the bed 2 so as to correspond to the needle bar 5. A shuttle mechanism (not shown) is provided at a position under the throat plate 2*a* in the bed 2. The needle bar 5, the shuttle mechanism, etc. are synchronously driven by a sewing machine motor 7 (shown only in FIG. 3) so that a sewing operation is executed.

An embroidering unit 8 is detachably attached to a left-hand end of the bed 2. The embroidering unit 8 comprises an embroidery frame 9 for holding the workpiece cloth and an embroidery frame moving mechanism 10 for moving the embroidery frame 9 horizontally, that is, in an X-axis direction and a Y-axis direction. The embroidery frame 9 includes an outer frame and an inner frame between which the workpiece cloth is sandwiched, so that the workpiece cloth can be held tightly stretched inside the embroidery frame 9 between the frame and the throat plate 2*a*.

Figure 3:
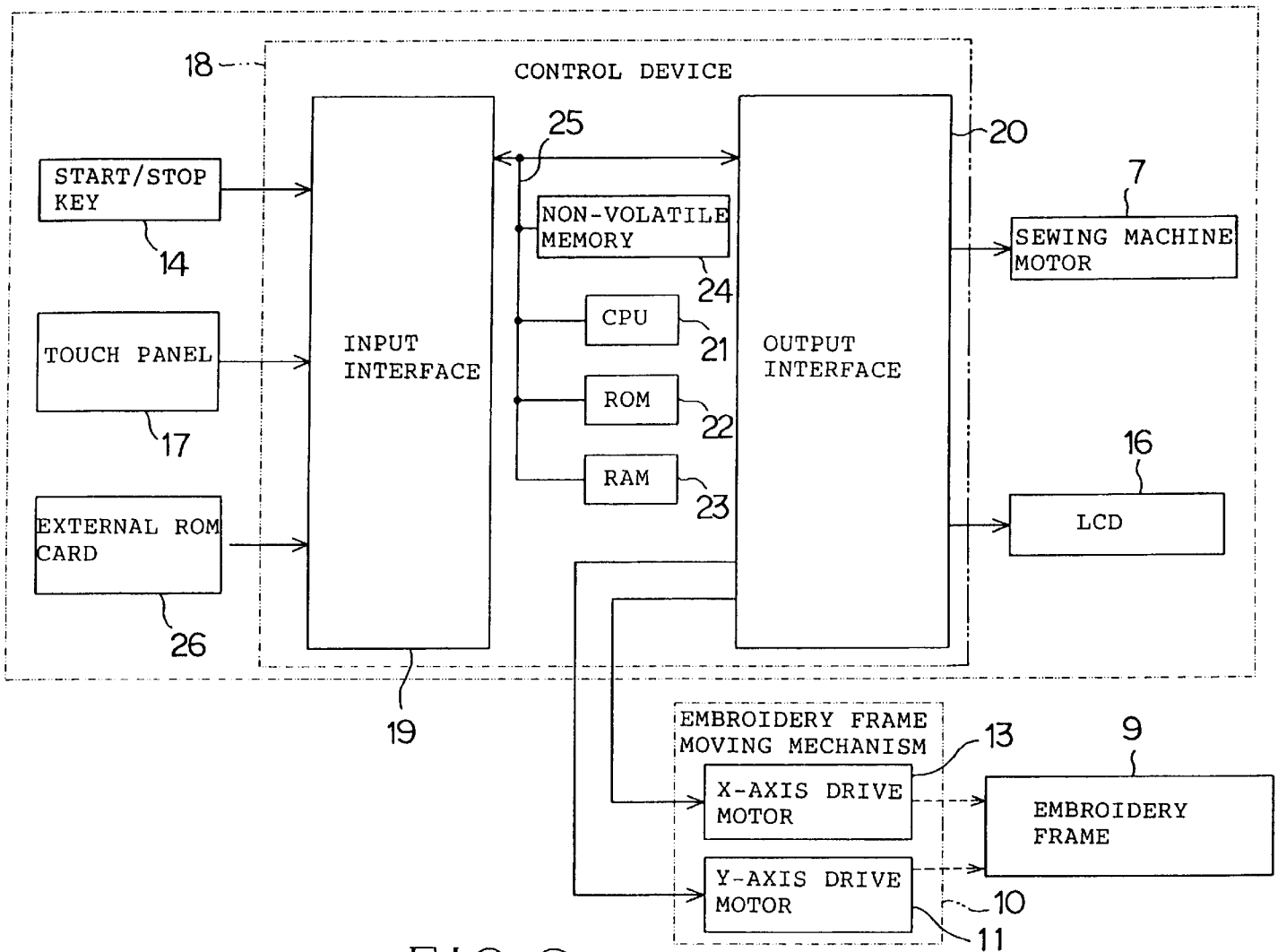
FIG. 3 is a block diagram showing an electrical arrangement of the embroidery machine.

The embroidery frame moving mechanism 10 comprises a movable member 12 moved by an X-axis drive motor 13 (shown only in FIG. 3) freely in the X-axis direction, that is, leftward and rightward as viewed in FIG. 3. The embroidery frame 9 is detachably attached to the movable member 12 to be moved by a Y-axis drive motor 11 in the Y-axis direction, that is, forward and backward as viewed in FIG. 3. Consequently, the workpiece cloth held by the embroidery frame 9 can be moved by the embroidery frame moving mechanism 10 to an optional position based on an intrinsic X-Y coordinate system. An embroidering operation is performed when the needle bar 5, shuttle mechanism, presser foot, etc. are driven by the respective drive mechanisms while the workpiece cloth is moved freely relative to the needle bar 5 by the embroidery frame moving mechanism 10.

The embroidery machine of the embodiment is capable of performing a variety of ordinary sewing modes such as straight stitching, zigzag stitching and overcast stitching as well as embroidering. In case that the embroidering is not carried out, the embroidering unit 8 is removed from the bed 2 to be replaced by a flat table (not shown) for the ordinary sewing modes.

A start/stop key 14 is provided on a front surface of the distal end of the arm 3 as shown in FIG. 2. A power switch 15 is provided on the lower right-hand side surface of the machine main body 1. A card insertion slot 27 is provided in the right-hand side wall of the main body 1. An external ROM card 26 is inserted into the card insertion slot 27. The external ROM card 26 serves as external storage means as will be described later.

A monochrome liquid crystal display (LCD) 16 is provided on the front surface of the arm 3. The LCD 16 serves as display means for displaying a variety of patterns and messages. A touch panel 17 (shown only in FIG. 3) is provided on the surface of the LCD 16. The touch panel 17 includes various operation keys as well known in the art. The touch panel 17 comprises a number of transparent electrodes arranged vertically and horizontally and detects where the user touches it, as well known in the art.

Figure 4:
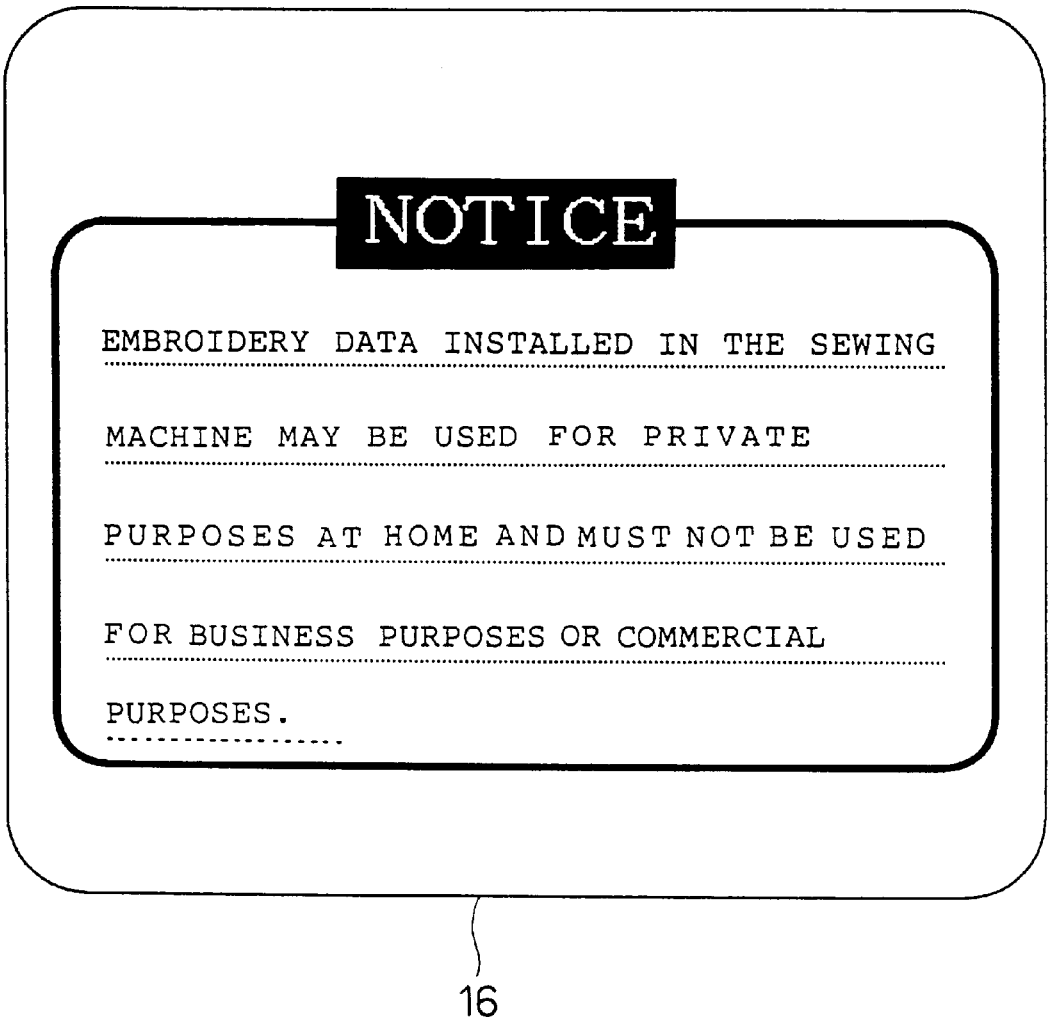
FIG. 4 shows a "NOTICE" screen displayed on a liquid crystal display (LCD)

Referring to FIG. 4, a microcomputer-based control device 18 is provided in the machine main body 1 for controlling the various mechanisms described above. The control device 18 includes an input interface 19, output interface 20, CPU 21, ROM 22, RAM 23, and a non-volatile memory 24 such as EEPROM or flush ROM all connected by a bus 25. The ROM 22 stores control programs for controlling the embroidering operation and other ordinary sewing operations of the embroidery machine, and a control program for controlling display of the LCD 16, a data processing program for performing various data processes such as readout and edit of embroidery data. The ROM 22 further stores embroidery data for determining outlines of a number of embroidery patterns including picture patterns and ornamental patterns formed by relatively simple shapes and for symbols and letters such as English alphabet, numerals and Japanese "kana." The ROM 22 thus serves as internal storage means in the invention.

In the embodiment, the embroidery data stored in the ROM 22 includes sewing data required for the embroidering, and display data formed from bit map data required for display of each pattern on the LCD 16. The sewing data is stored in the ROM 22 in the form of coordinate data for indicating an outline or contour of each pattern. When the embroidering is to be executed, calculations are performed on the coordinate data to develop it into data indicating each needle location, that is, amounts of movement of the workpiece cloth in the X-axis and Y-axis directions for each stitch. Furthermore, the same data can be used for both sewing data and display data. Alternatively, either one set of the data can be stored and developed into the other set of data.

The sewing machine motor 7, X-axis and Y-axis drive motors 13 and 11 of the embroidery frame moving mechanism 10, LCD 16, etc. are connected to the output interface 20 so as to be controlled by the control device 18. The touch panel 17 and start/stop key 14 are connected to the input interface 19 so that detection signals from the touch panel 17 and switch signals from the start/stop key 14 are delivered to the control device 18. The above-mentioned external ROM card 26 is adapted to be connected to the input interface 19.

The external ROM card 26 stores embroidery data (sewing data and display data) of a number of specified embroidery patterns, for example, a plurality of character patterns each of which is protected by copyright. The external ROM card 26 further stores data of attributes of the characters of the respective embroidery patterns or data indicating as to whether the characters are protected by copyright, and data of the limited number of times of sewing with respect to each embroidery data. The limited number of times of sewing will be described in detail later. FIG. 9 shows the data structure in the external ROM card 26. Regarding the embroidery patterns stored in the ROM 22, too, data of attributes of the characters and data of the limited number of times of sewing are stored in ROM 22 together with the embroidery data.

Based on the programs stored in the ROM 22 and selecting operations performed on the touch panel 17 by the user, the control device 18 controls the various mechanisms of the embroidery machine so that the embroidering and other ordinary sewing operations are executed. As will be apparent from the following description, the control device 18 controls the LCD 16 to display thereon a menu selecting screen (see FIG. 5) and a pattern selecting screen (see FIG. 6) containing a number of patterns displayed. The user can select a desired embroidery pattern by touching the touch panel 17. Additionally, the control device 18 counts or accumulates, by means of software, the number of times of use of the embroidery data or the number of times of sewing when the embroidery forming operation has been executed on the basis of the embroidery data of each character pattern. The control device 18 further stores the count in the non-volatile memory 24, as will be described later. The control device 18 and non-volatile memory 24 thus serve as count means in the invention. The non-volatile memory 24 stores data of the number of times of sewing with respect to each of the embroidery patterns as shown in FIG. 10.

When the user selects each character pattern, the control device 18 compares the number of times of sewing of each embroidery pattern the data of which is stored in the non-volatile memory 24 with the limited number of times of sewing stored the data of which is stored in the ROM 22, thereby judging whether the embroidery data of each character pattern is unfairly used, on the basis of the result of comparison. The control device 18 thus serves as judging means in the invention.

When the embroidery data of the each character pattern is used for the business purposes or commercial purposes, the number of times of sewing would become larger as compared with the case where the sewing is executed on the basis of the embroidery data of each character pattern for the private purposes at home. In view of this, the number of times at which the sewing is executed on the basis of the embroidery data of each character pattern at home is roughly calculated in the embodiment. The limited number of times of sewing is determined to be remarkably larger than the roughly calculated number of times, for example, 1000 times. Accordingly, when the number of times of sewing of the character pattern the data of which is stored in the non-volatile memory 24 exceeds the limited number of times of sewing, the control device 18 judges that the embroidery data of the character pattern has unfairly been used. In the embodiment, when the embroidery data has been judged to be unfairly used, the control device 18 controls the LCD 16 to display on the pattern selecting screen thereof a message (see FIG. 8) that the embroidery pattern cannot be selected. Furthermore, the control device 18 prohibits the embroidery data of the character pattern from being selected. Accordingly, the control device 18 and LCD 16 serve as informing means in the invention. The control device 18 further serves as prohibiting means in the invention.

Figure 2:
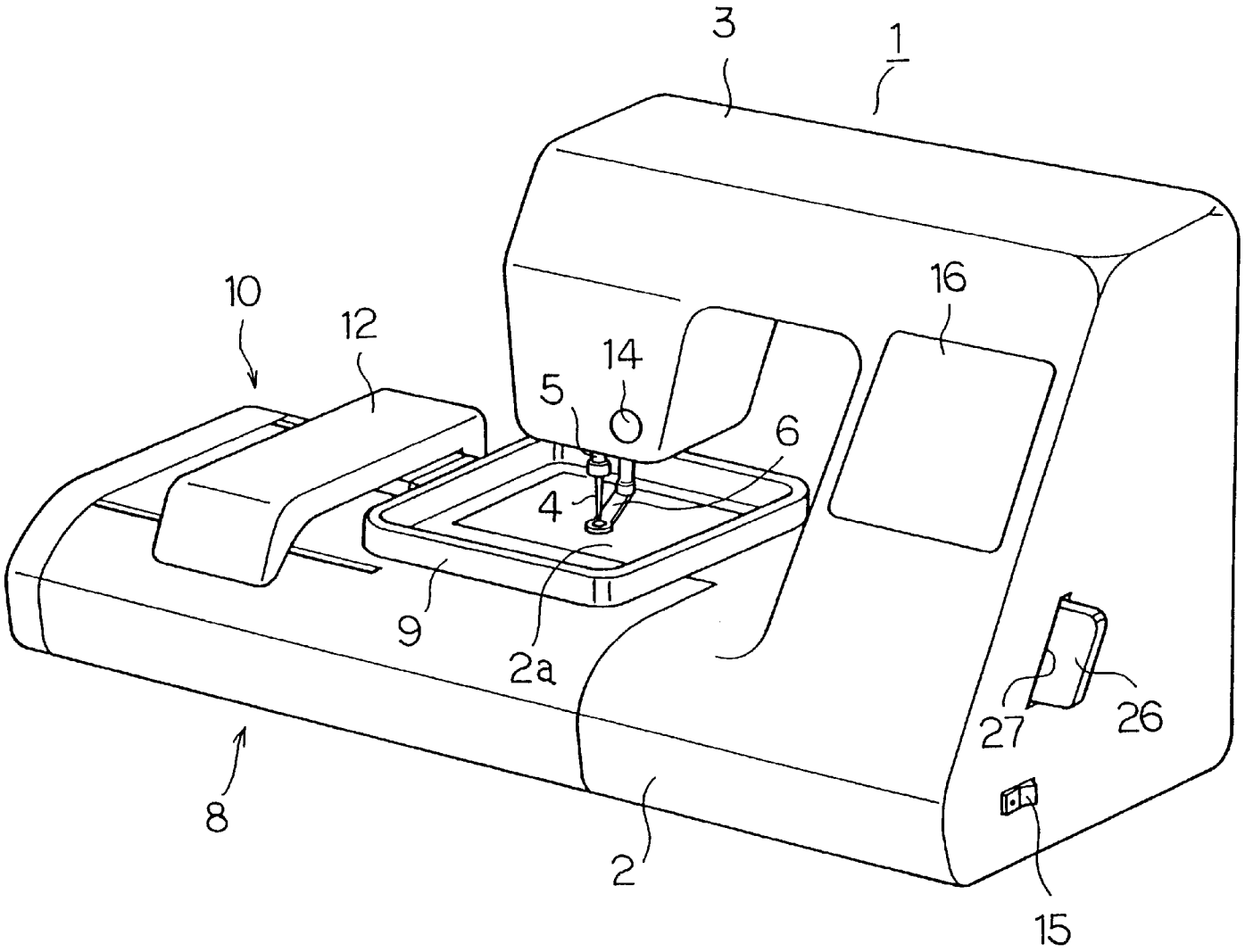
FIG. 2 is a perspective view of the embroidery machine.
Figure 5:
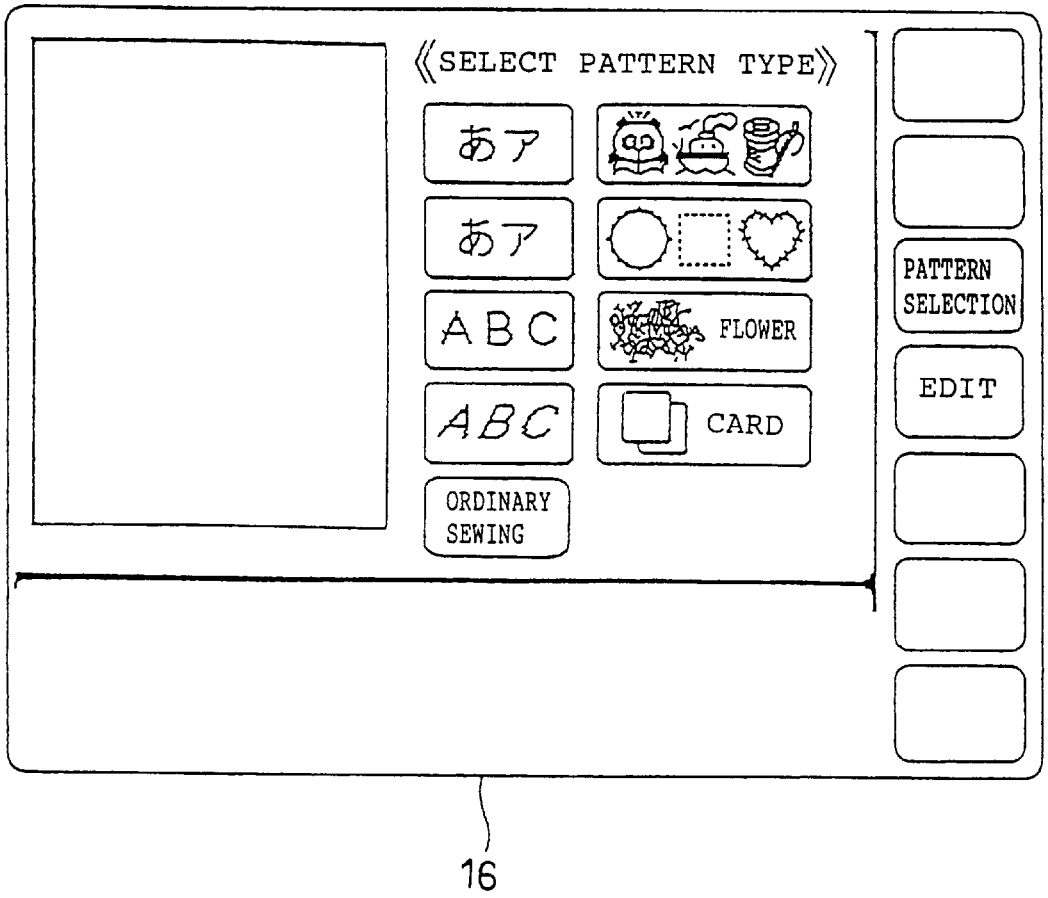
FIG. 5 shows a menu selecting screen (initial screen) displayed on the LCD.

The operation of the embroidery machine will be described with reference to FIG. 1 showing the processing procedures from selection of an embroidery pattern to the sewing. The LCD 16 displays the NOTICE screen as shown in FIG. 4 for a predetermined period of time, for example, several seconds when the power switch 15 is turned on. This NOTICE screen displays a message as described above. Subsequently, the LCD 16 displays a menu selecting screen (initial screen) at step S1 as shown in FIG. 5. The menu selecting screen displays nine selected items, that is, eight items obtained by classifying a number of embroidery patterns and one item of ordinary sewing. An item of CARD represents an embroidery pattern whose data is stored in the external ROM card 26. The other items on the screen represent the embroidery patterns stored in the ROM 22 respectively. The user operates the touch panel 17 to select an item corresponding to a desired embroidery pattern. The LCD 16 is then switched to a pattern selecting screen (step S2).

Figure 6:
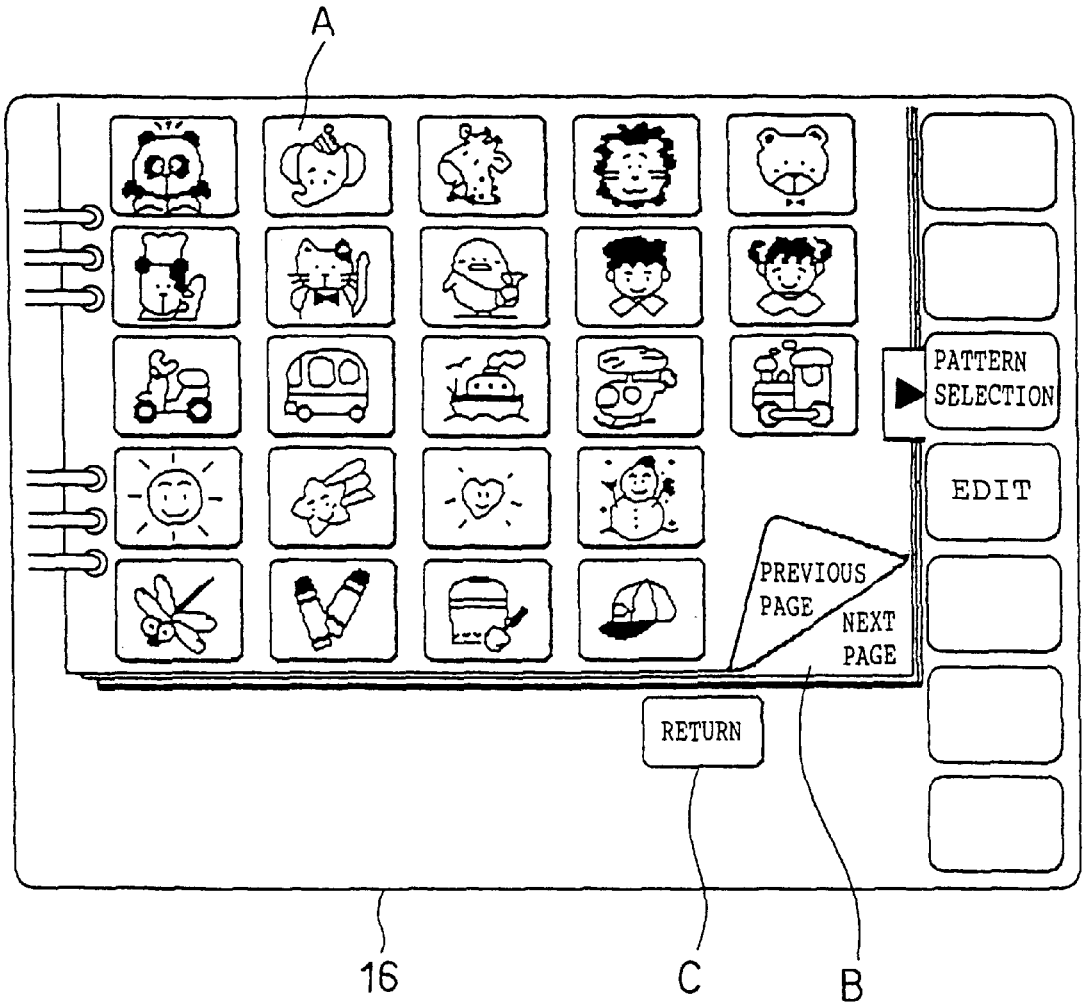
FIG. 6 shows an example of pattern selecting screen displayed on the LCD.

Assume now that the user selects a right-hand upper item of picture pattern in FIG. 5. The screen of the LCD 16 is then switched from the menu selecting screen of FIG. 5 to the pattern selecting screen concerning the selection of picture pattern as shown in FIG. 6 on the basis of the embroidery data (display data) stored in the ROM 22. The pattern selecting screen as shown in FIG. 6 displays a number of picture patterns A including panda, elephant, giraffe, lion, etc. For example, the panda designates a first embroidery pattern, the elephant a second embroidery pattern, and the giraffe a third embroidery pattern. Since the number of embroidery patterns displayed on a single screen is limited, the pattern selecting screen is provided over a plurality of pages. The pattern selecting screen is switched from one page to another when a page switch key B provided on a right-hand lower corner of the screen is operated. A RETURN key C is operated to return to the menu selecting screen.

A desired embroidery pattern is selected (YES at step S3) when the user touches the touch panel 17 on the pattern selecting screen. A judgment is then made as to whether the selected embroidery pattern is a character pattern (step S4). The control sequence advances to a selected pattern processing at step S5 when the selected embroidery pattern is not a character pattern (NO at step S4).

On the other hand, when the selected embroidery pattern is a character pattern (YES at step S4), the data of the number of times of sewing stored in the non-volatile memory 24 with respect to the selected embroidery pattern is read (step S6). A judgment is made at step S7 as to whether the read number of times of sewing has reached the limited number of times of sewing. The control sequence advances to the selected pattern processing at step S5 when the number of times of sewing is below the limited number of times of sewing (NO at step S7).

Figure 7:
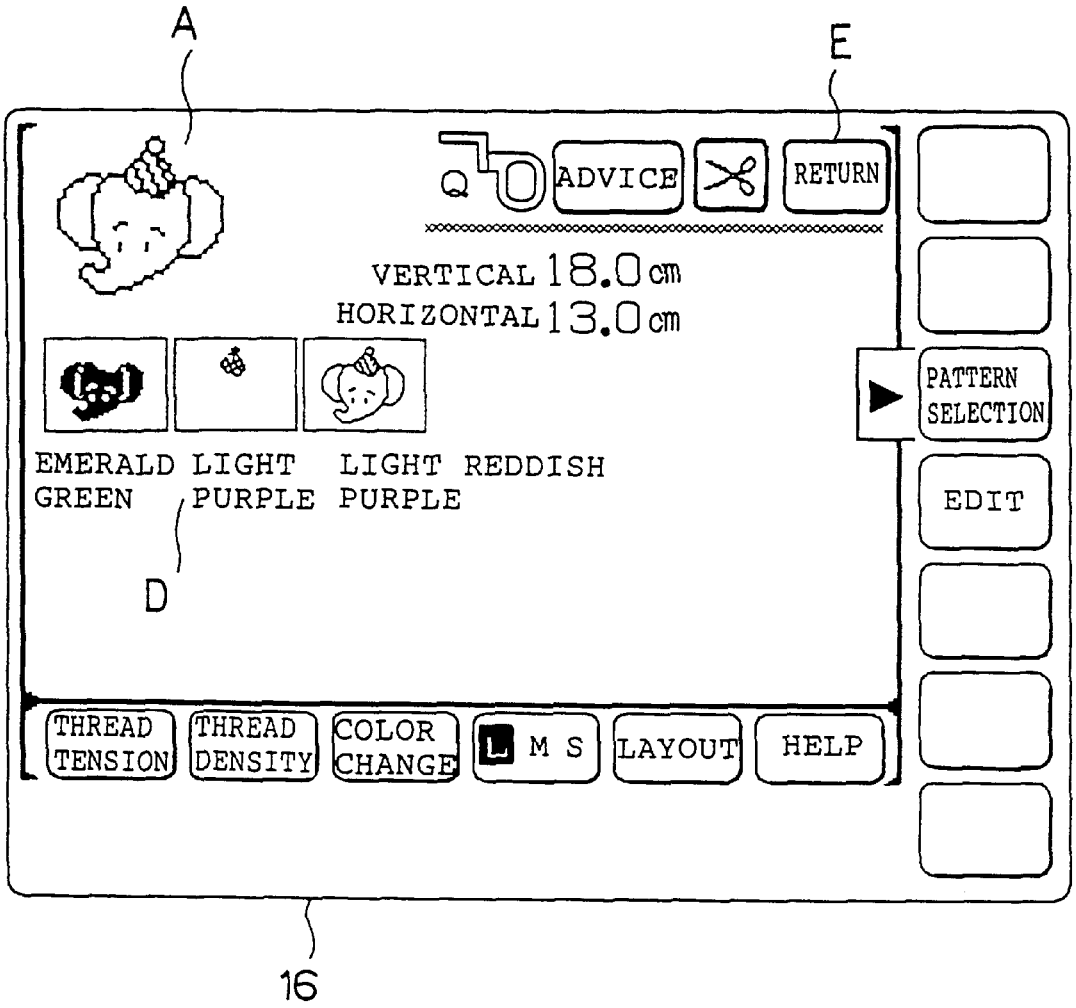
FIG. 7 shows an example of confirmation screen displayed on the LCD.

In the selected pattern processing, the embroidery data (sewing data) is read from the ROM 22 or the external ROM card 26 to be written into a predetermined storage region of the RAM 23. Furthermore, a confirmation screen as shown in FIG. 7 is displayed on the LCD 16. An enlarged picture pattern A or the elephant pattern selected by the user is displayed on the confirmation screen. Furthermore, divided portions D of the picture pattern A divided according to thread colors (three colors in the embodiment) are displayed on the confirmation screen together with names of thread colors. A RETURN key E provided on the right-hand upper portion of the confirmation screen is touched so that the LCD 16 is returned to the pattern selecting screen.

In the embodiment, a plurality of embroidery patterns can be combined together when the LCD 16 is switched to an edit mode or edit screen (not shown) although this is not described in detail. In this case, the combined embroidery patterns can continuously be formed on the workpiece cloth by one sewing operation.

The sewing operation is executed on the basis of the sewing data written into the RAM 23 (step S9) when the start/stop key 14 is turned on upon completion of the embroidery selection (YES at step S8). The sewing operation is interrupted every time one divided portion D is sewn. The sewing operation for the subsequent divided portion D is re-started upon replacement of one color of thread by another by the user.

Figure 8:
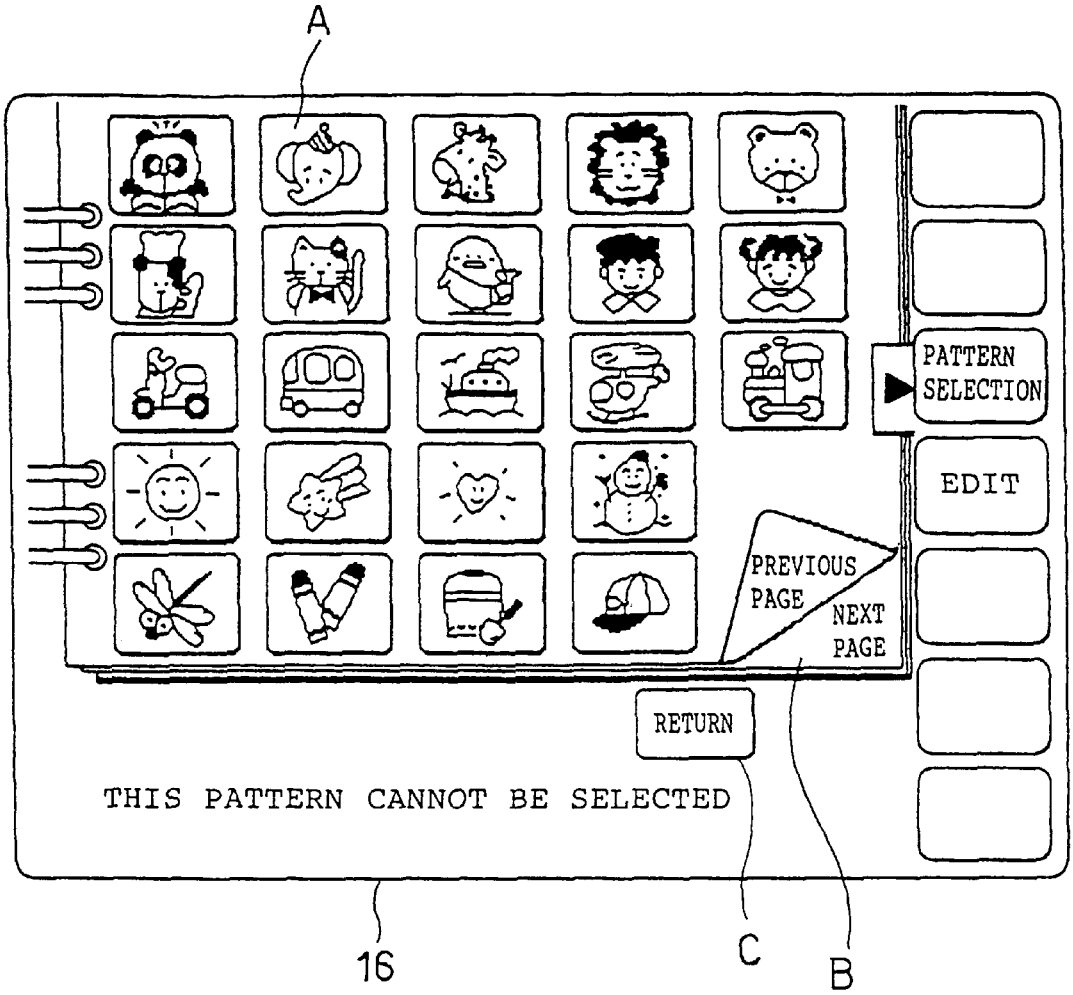
FIG. 8 shows another example of confirmation screen displaying a message that the pattern cannot be selected.

Upon completion of the sewing operation, a judgment is made at step S10 as to whether the embroidery pattern is a character pattern. When the embroidery pattern is a character pattern, the number of times of sewing stored in the non-volatile memory 24 with respect to the embroidery pattern is incremented by one (step S11). On the other hand, when the number of times of sewing with respect to the embroidery pattern is at or above the limited number of times of sewing (1000 times) at step S7, the selection of the embroidery pattern is not accepted, and the pattern selecting screen of the LCD 16 displays a message that the embroidery pattern cannot be selected, as shown in FIG. 8, at step S13. Furthermore, the previous selection of the embroidery pattern is maintained when the sewing operation has been completed. Accordingly, when the same embroidery pattern is to be repeatedly sewn, the use turns on the start/stop key 14 so that the sewing operation is executed. More specifically, the confirmation screen is displayed on the LCD 16 (step S14) unless power is turned off upon completion of the sewing operation (NO at step S12). The confirmation screen maintains the embroidery pattern for the last executed sewing operation. Accordingly, when the same embroidery pattern is repeatedly sewn (NO at step S14), the sewing operation is executed (step S9) when the start/stop key 14 is turned on (step S8). Furthermore, the RETURN key E is touched (YES at step S14) when an embroidery pattern differing from the last selected one is selected. The LCD 16 then displays the pattern selecting screen (step S2). A desired embroidery pattern is selected and then, the sewing operation is executed on the basis of the selected embroidery pattern as described above (steps S3 to S9).

According to the foregoing embodiment, the number of times of sewing executed on the basis of the embroidery data of the character pattern is accumulated. The embroidery data is judged to be unfairly used when the accumulated number of times exceeds the limited number of times of sewing. Consequently, a simpler arrangement can be achieved for judging whether the embroidery data of the character pattern is unfairly used. Furthermore, the sewing operation is prohibited from being executed on the basis of the embroidery data after the data has been judged to be unfairly used. This arrangement can prevent the use of the embroideries formed on the basis of the character pattern for the business purposes or commercial purposes, for example, merchandising a number of embroideries formed on the character pattern.

Furthermore, the LCD 16 displays the message that the character pattern cannot be selected, when the embroidery data of the character pattern has been judged to be unfairly used. Consequently, the user can reliably be informed that the character pattern cannot be selected. Additionally, the LCD 16 displays the NOTICE screen when power is supplied to the embroidery machine. This NOTICE screen can prevent the embroidery data or more specifically, the embroidery data of the character patterns from being used for the business purposes or commercial purposes.

The number of times of sewing with respect to each of the combined character patterns is incremented by one in the foregoing embodiment since one continuous sewing operation is executed. Instead, the number of times of sewing with respect to each of the combined character patterns may be counted up by a number corresponding to the number of the combined character patterns.

In the foregoing embodiment, the number of times of sewing is counted when the overall embroidery forming operation is completed on the basis of the selected embroidery data. Instead, the number of times of sewing may be counted immediately before completion of the embroidery forming operation or in the midst of the embroidery forming operation after elapse of a predetermined time from the start thereof. Furthermore, the number of times of use of sewing may be counted before a final stop stitch is formed with the embroidery portion being completed.

A second embodiment of the invention will be described with reference to FIGS. 11, 12A and 12B. Differences between the first and second embodiments will be described. Identical parts are labeled by the same reference symbols as in the first embodiment. In the second embodiment, whether the number of times of sewing with respect to each character pattern has exceeded the limited number of times of sewing or whether the embroidery data of each character pattern is unfairly used is judged when the start of the sewing operation is instructed. When the embroidery data is judged to be unfairly used, a sewing operation differing from the sewing operation normally executed on the basis of the embroidery data is executed.

Figure 11:
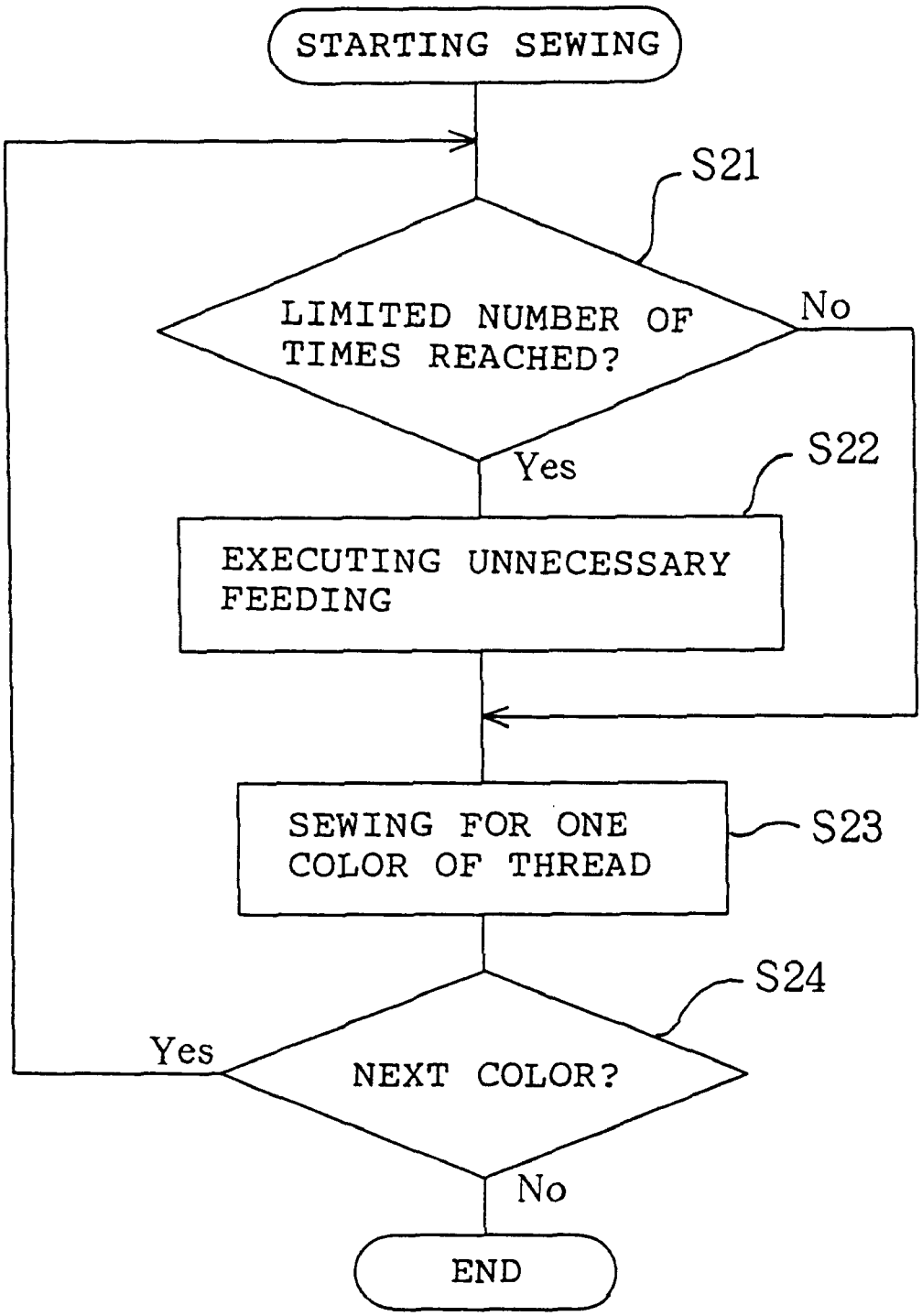
FIG. 11 is a flowchart showing processing procedures in the case of selection of an embroidery pattern in an embroidery machine of a second embodiment in accordance with the present invention.
Figure 12A:
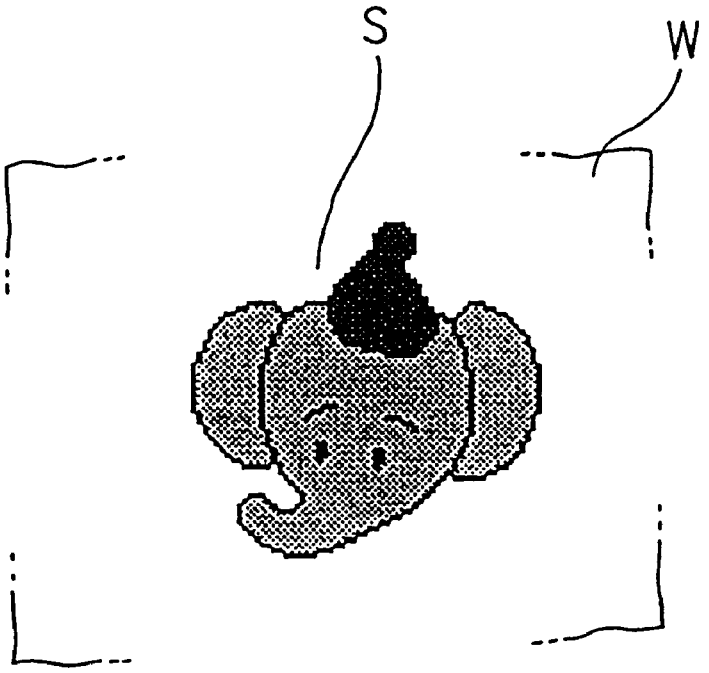
FIGS. 12A and 12B show an embroidery formed by the normal sewing operation on the basis of the embroidery data and an embroidery formed in addition of unnecessary feed of an embroidery frame, respectively.
Figure 12B:
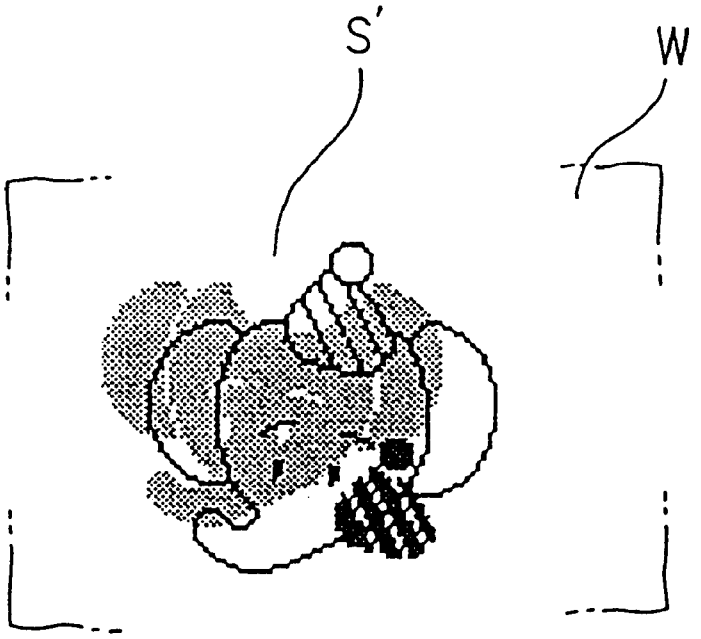

Referring to FIG. 11, when the start/stop key 14 is turned on upon completion of the process for selecting the character pattern, a judgment is made at step S21 as to whether the number of times of sewing of the selected character pattern the data of which is stored in the non-volatile memory 24 has reached the limited number of times of sewing. The sewing operation is executed for one of the divided portions D of the character pattern corresponding to one thread color (step S23) when the limited number of times of sewing has not been reached (NO at step S21). When the selected character pattern includes another divided portion D (YES at step S24), the processes at steps S21 to S24 are repeated after exchange of the thread of one color for the one of another color. The number of times of sewing of the character pattern whose data is stored in the non-volatile memory 24 is incremented by one upon completion of the sewing operation for all the divided portions D of the character pattern.

On the other hand, when the number of times of sewing of the character pattern is judged to have reached the limited number of times of sewing (YES at step S21), an unnecessary feed of the embroidery frame 9 is executed at step S22. Thereafter, the sewing operation is executed for one divided portion D at step S23. For execution of the unnecessary feed of the embroidery frame 9 for each of the divided portions D, data of an optional amount of feed is added to the sewing data of amounts of movement of the embroidery frame 9 in each of the X-axis and Y-axis directions at the time of start of the sewing operation. Consequently, the embroidery of the selected character pattern is not formed at a regular location on the workpiece cloth. More specifically, when the picture pattern A of the elephant has been selected as in the first embodiment, for example, the picture pattern A is divided into three divided portions D, that is, the divided portion of the face of the elephant, the divided portion of the cap, and the divided portion of the outline of the elephant and cap. A thread of emerald green is used to form the first divided portion D of the face, a thread of light purple is used to form the second divided portion D of the cap, and a thread of light reddish purple is used to form the third divided portion D of the outline. On one hand, FIG. 12A shows an embroidery S of the elephant formed when the sewing operation is regularly executed on the basis of the embroidery data of the picture pattern A as described above. On the other hand, FIG. 12B shows the embroidery S of the elephant formed on the workpiece cloth W when the sewing operation is executed with the unnecessary feed of the embroidery frame 9 as described above being added. As shown in FIG. 12B, the face of the elephant is shifted upwardly rightward relative to the outline of the elephant and cap. The cap is shifted downwardly leftward relative to the outline of the elephant and cap. Consequently, an embroidery S' formed on the workpiece cloth W differs from the normal embroidery S and is accordingly a failure. Different kinds of meshes and solid line are employed in FIGS. 12A and 12B to show the respective divided portions D of different colors.

According to the second embodiment, the embroidery formed on the basis of the selected character pattern is compelled into a failure when the number of times of sewing with respect to the selected character pattern has reached the limited number of times of sewing. Consequently, the user cannot use the formed embroidery for the business purposes or commercial purposes. Furthermore, since the sewing operation is executed in vain, the productivity would be reduced. Additionally, only the embroidery frame 9 is operated to perform the unnecessary feed, and the other mechanisms are normally operated. Consequently, the drive mechanisms of the embroidery machine can be prevented from being damaged by the unnecessary feed of the embroidery frame 9.

In the second embodiment, the unnecessary feed is added to the embroidery frame 9 at the time of start of the sewing operation for each of the divided portions D so that the sewing start location differs from the regular location with respect to each of the divided portions D. Instead, the unnecessary feed may be added to the embroidery frame 9 during the sewing operation for each of the divided portions D. As a result, the embroidering can result in a failure even when the selected embroidery pattern includes only one divided portion D or the embroidery is formed with a single color of thread.

In the second embodiment, furthermore, the unnecessary feed is added to the movement of the embroidery frame 9 in each of the X-axis and Y-axis directions so that the embroidering results in the failure. The unnecessary feed may be added to the motion of the embroidery frame 9 in the X-axis or Y-axis direction. Furthermore, the amount of movement of the embroidery frame 9 in the X-axis direction may be doubled or the thread may be rocked. Moreover, the exchange of one color of thread for another color of thread may be ignored in the case of a multicolor embroidery so that a single color of embroidery is formed. The sewing operation may be executed with part of the embroidery data being eliminated or on the basis of the embroidery data of an embroidery pattern differing from that of the selected embroidery pattern.

The number of times of sewing with respect to each of the embroidery data is sequentially incremented in the foregoing embodiments. However, a previously set number of times may be decremented at every time of use of each embroidery data. In this case, each embroidery data is judged to be unfairly used when the set number of times has reached zero.

Data of a code number with respect to each of the embroidery patterns may be stored in both of the external ROM card 26 and the ROM 22, so that the judgment as to whether the selected embroidery pattern is a character pattern is based on the code number. In this case, the code numbers for the respective character patterns are previously set.

The embroidery data may be judged to be unfairly used when the number of times of sewing for a predetermined period of time (one week, for example) has exceeded the limited number of times or when the sewing operation on the basis of the same specified embroidery pattern is repeated at a preselected number of times or more.

In the foregoing embodiments, the number of times of use of each specified embroidery pattern is counted when the sewing operation has been executed on the basis of each specified embroidery pattern. Instead, the number of times may be counted when each specified embroidery pattern has been selected or when the embroidery data (sewing data) of each specified embroidery pattern stored in the external ROM card 26 has been written into the RAM 23.

The following timing for the count of the number of times of use of the sewing data may be considered. That is, the number of times of use of the sewing data may be counted when:

1. the embroidery forming operation has been executed with a thread of one color with respect to each character pattern;
2. the thread of one color has been changed to that of another color with respect to each character pattern;
3. a predetermined combination of a plurality of character patterns has been selected, for example, a combination of a hero or heroine character and his sweetheart or her lover character, or a hero or heroine character and his or her rival character;
4. a specified pattern, for example, a specific profile or the letter "C" of the term, "copyright" has been sewn;
5. each character pattern has been selected and the start/stop key 14 has then been turned on;
6. an end code of the embroidery or sewing data of each character pattern has been read;
7. stop data contained in the embroidery or sewing data of each character pattern immediately before finish of sewing has been read;
8. the embroidery data of each character pattern has been read from the ROM 22 or the external ROM card 26;
9. the embroidery or sewing data of each character pattern has been read to be written into the RAM 23;
10. a predetermined sewing speed or frame moving pattern set in the sewing data of each character pattern has been executed;
11. code data contained in the sewing data of character pattern has been read;
12. the embroidery machine has been turned to a mode in which each character pattern can be selected;
13. a total number of times of vertically reciprocal movement of the needle for sewing or a rotational speed of arm shaft has reached a predetermined value;
14. power is supplied to the embroidery machine or an original point of the embroidery frame has been detected; or
15. the external ROM card has been inserted into the insertion slot.

In the foregoing embodiments, the number of times of use of the embroidery data is counted to be stored with respect to each of the embroidery patterns. A total number of times of use with respect to all the specified embroidery patterns may be counted or the counting may be performed every time the embroidery data of any one of the specified embroidery patterns has been used. Furthermore, although the data of the number of times of use of each embroidery data is stored in the non-volatile memory 24 of the control device 18 in the foregoing embodiments, the data may be stored in the external ROM card 26 or both of the non-volatile memory 24 and the external ROM card 26, instead.

The limited numbers of times of use of the embroidery patterns are uniformly set on the basis of frequency in use of the embroidery machine in the foregoing embodiments. However, the limited number of times of use may differ from one specified embroidery pattern to another, instead. Furthermore, the frequency of use of the embroidery data may be increased in a family with a large number of children than a family with a smaller number of children. Accordingly, the dealer may set the limited numbers of times of use according to the number of children. Furthermore, when the embroidery machines are rented, the limited numbers of times may be set according to a rental fee paid by the user.

Furthermore, the invention may be applied to a case where embroidery data of a character pattern for trial embroidering in which the embroidery can be formed once is stored in the internal and external storage means. In this case, the limited number of times of use is one. Upon completion of a one time of the embroidery forming operation, the embroidery data is rendered non-selectable, and an advertisement for the embroidery pattern, types of the embroidery card, etc. may be displayed.

The prohibiting operation by the prohibiting means or the controlling operation by the control means may be performed in the following manners when the number of times of use of each specified embroidery pattern has reached the limited number of times or each specified embroidery pattern has been judged to be unfairly used. First, regarding the processes in which the embroidery machine is switched into an operation mode differing from a proper mode:

1. Power supply to the embroidery machine may be prohibited;
2. A buzzer may be kept activated;
3. The screen of the LCD 16 may be brightened or dimmed to a maximum extent;
4. The external ROM card 26 may be prohibited from being inserted into the machine body 1 or from being detached therefrom;
5. The acceptance of the external ROM card 26 may be prohibited by a software arrangement;
6. The ordinary sewing mode may be maintained even when the embroidering unit 8 is attached to the machine body 1; or
7. Power may be turned off when the external ROM card 26 is inserted into the machine body 1.

The following Nos. 8 to 10 are examples in which the embroidery pattern is prohibited from being selected:

8. The transition to the pattern selecting screen may be prohibited;
9. The pattern selecting keys may be prohibited from being displayed or crosses may be displayed on the pattern selecting keys; or
10. The size of the pattern or quantity of data may falsely exceed the limit.

The following Nos. 11 to 20 are examples in which the sewing operation cannot normally be executed though the pattern can be selected:

11. The acceptance of the starting operation may be prohibited after the pattern selection;
12. A thread sensor may be switched into a false error state;
13. A machine motor may be switched into a false locked condition;
14. The presser foot 6 may be held in a raised state;
15. Specified patterns may slowly be sewn;
16. The embroidery frame 9 may be rendered immovable during the sewing;
17. The thread may be prohibited from being drawn out or may be drawn out in an improper manner;
18. Unnecessary thread cutting may frequently be executed;
19. Drive power may be reduced so that the pulse motor is easily led into loss of synchronism; or
20. Layout, edit and help functions may be restricted.

The following Nos. 21 to 27 are other examples:

21. When the number of times of use has reached the limited number of times of sewing, a specified error message may be displayed together with the telephone and facsimile numbers so that a contact with the maker or dealer is urged. In this case, the maker or dealer may cancel the prohibition in case that the user has good faith;
22. A message informing of illegality may be displayed or the sewing operation may be prohibited from being stopped;
23. A serial number may be stored in the external ROM card 26 when the number of times of use has reached the limit value, so that the external ROM card cannot be used with another sewing machine;
24. Codes may be stored in both of the machine and the external ROM card 26 respectively so that the sewing operation is executed only when the codes agree with each other, whereas a prohibiting process is carried out when the codes disagree with each other;
25. A formed embroidery may contain a code indicative of a production number of the sewing machine or external ROM card so that the user can be specified by the formed embroidery;
26. The data stored in the external ROM card 26 or the card itself may be destructed when the number of times of use has reached a limit value; or
27. The external ROM card 26 may falsely be destructed or the destruction of the card may be displayed when a normal external ROM card 26 is inserted into an unjustly used sewing machine.

There is a possibility that the number of times of use of the embroidery data of a character pattern may exceed the limited number of times of sewing when the user uses the embroidery machine for a long period of time at home to normally form the embroidery of the character pattern. This bona fide use of the embroidery data should not be regarded as equivalent to the use for the business purposes or commercial purposes. In view of the above-described situation, a judgment may be made as to whether the user has a good faith. When the user has been judged to have a good faith, the prohibition of the use of the embroidery data of the specified embroidery pattern for the sewing operation may be canceled, or the operation differing from a normal sewing operation may be returned to the normal sewing operation. Furthermore, the accumulated number of times of use with respect to the embroidery data of each specified embroidery pattern may be reset on the basis of judgment as to whether the user has a good faith. In this case, the judgment as to whether the user has a good faith may be made by the maker or dealer. The maker or dealer cancels the prohibition by the prohibiting means or returns the operation to the normal sewing operation. Alternatively, the control device 18 may be designed to function as judging means for judging whether the user has a good faith, and as canceling means for canceling the prohibition by the prohibiting means or as return means for returning the operation differing from the normal sewing operation to the normal sewing operation.

The embroidery data of each specified embroidery pattern may be stored in the ROM 22 installed in the embroidery machine as well as in the external ROM card 26.

Furthermore, the invention may be applied to sewing machines for industrial or business use as well as to the household embroidery machine. In the industrial or business use, too, the embroidery data can be prevented from an excessive use. The invention may further be applied to an apparatus independent of the sewing machine, for example, an embroidery unit (apparatus for moving a workpiece cloth) as disclosed in Japanese patent publication No. 8-299632-A. The disclosed embroidery unit is detachably attached to a sewing machine and provided with a ROM for storing the embroidery data. The invention may further be applied to an apparatus for treating only with data for origination and editing of embroidery data, etc. and overall apparatus for processing embroidery data, for example, apparatus for converting data format of embroidery data.

The storage means may store the embroidery data of only one specified embroidery pattern. In this case, too, unfair use of the embroidery data of the specified embroidery pattern can be prohibited.

Different types of sewing machines may be installed with different sewing operation programs. Furthermore, the same type of sewing machines may be installed with different sewing operation programs. The invention may be applied to these cases.

The prohibiting or controlling operation executed after the judgment of unfair use should not be limited to one mode. The prohibiting operation may be executed twice or more. A second prohibiting operation may be executed in a more stringent mode than a first prohibiting operation.

The embroidery data may be supplied to the embroidery machine by means of wireless communication or internet communication system.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. An embroidery data processing device comprising:

storage means for storing embroidery data of one or more embroidery patterns used for execution of at least one sewing operation, the embroidery patterns including at least one specified embroidery pattern;

processing means reading the embroidery data from the storage means for processing the read embroidery data;

judging means for judging whether the embroidery data of the specified embroidery pattern has unfairly been used; and prohibiting means for prohibiting use of the embroidery data of the specified embroidery pattern for the sewing operation when the judging means judges that the embroidery data of the specified embroidery pattern has unfairly been used.

2. A device according to claim 1, wherein the prohibiting means prohibits the embroidery data of the specified embroidery pattern from being read from the storage means.

3. A device according to claim 1, further comprising informing means for informing of unfair use of the embroidery data of the specified embroidery pattern when the judging means judges that the embroidery data of the specified embroidery pattern has unfairly been used.

4. A device according to claim 2, further comprising informing means for informing of unfair use of the embroidery data of the specified embroidery pattern when the judging means judges that the embroidery data of the specified embroidery pattern has unfairly been used.

5. A device according to claim 1, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

6. A device according to claim 2, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

7. A device according to claim 3, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

8. A device according to claim 4, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

9. A device according to claim 1, further comprising canceling means for canceling the prohibition of the use of the embroidery data of the specified embroidery pattern for the sewing operation by the prohibiting means.

10. An embroidery data processing device for an embroidery machine comprising:

storage means for storing embroidery data of one or more embroidery patterns used for execution of at least one sewing operation, the embroidery patterns including at least one specified embroidery pattern;

processing means reading the embroidery data from the storage means for processing the read embroidery data;

sewing control means for controlling the machine so that the sewing operation is executed on the basis of the embroidery data processed by the processing means;

judging means for judging whether the embroidery data of the specified embroidery pattern has unfairly been used; and control means for controlling the machine so that at least one sewing operation differing from at least one normal sewing operation on the basis of the embroidery pattern of the specified embroidery pattern is executed, when the judging means judges that the embroidery data of the specified embroidery pattern has unfairly been used.

11. A device according to claim 10, wherein the embroidery machine comprises a sewing needle and executes the sewing operation by moving a workpiece cloth relative to the sewing needle, and wherein the control means controls the machine so that the workpiece cloth is moved in at least one manner differing from at least one normal manner when the judging means judges that the embroidery data of the specified embroidery pattern has unfairly been used.

12. A device according to claim 10, further comprising informing means for informing of unfair use of the embroidery data of the specified embroidery pattern when the judging means judges that the embroidery data of the specified embroidery pattern has unfairly been used.

13. A device according to claim 11, further comprising informing means for informing of unfair use of the embroidery data of the specified embroidery pattern when the judging means judges that the embroidery data of the specified embroidery pattern has unfairly been used.

14. A device according to claim 10, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

15. A device according to claim 11, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

16. A device according to claim 12, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

17. A device according to claim 13, which further comprises count means for counting the number of times of use of the embroidery data of the specified embroidery pattern and wherein the judging means judges whether the embroidery data of the specified embroidery pattern has unfairly been used, on the basis of the number of times of use counted by the count means.

18. A device according to claim 10, further comprising return means for returning the operation differing from a normal sewing operation to the normal sewing operation.

19. An embroidery data processing device to which external storage means for storing embroidery data of one or more embroidery patterns used for execution of at least one sewing operation is connectable, the embroidery patterns including at least one specified embroidery pattern, the device comprising;

processing means reading the embroidery data from the external storage means for processing the read embroidery data;

judging means for judging whether the embroidery data of the specified embroidery pattern has unfairly been used; and prohibiting means for prohibiting use of the embroidery data of the specified embroidery pattern for the sewing operation when the judging means judges that the embroidery data of the specified embroidery pattern has unfairly been used.

20. A device according to claim 19, which further comprises count means for counting the number of times of use of the embroidery data of the specified embroidery pattern, and wherein the judging means judges whether the embroidery data of the specified embroidery pattern has unfairly been used, on the basis of the number of times of use counted by the count means.

21. A storage medium for storing at least one program for operating at least one embroidery data processing device so that at least one sewing operation is executed on the basis of embroidery data of one or more embroidery patterns stored in internal or external storage means, the embroidery patterns including at least one specified embroidery pattern, the program accomplishing the functions of:

processing means reading the embroidery data from the storage means for processing the read embroidery data;

judging means for judging whether the embroidery data of the specified embroidery pattern has unfairly been used; and prohibiting means for prohibiting use of the embroidery data of the specified embroidery pattern for the sewing operation when the judging means judges that the embroidery data of the specified embroidery pattern has unfairly been used.

22. A storage medium according to claim 21, wherein the program further accomplishes the function of count means for counting the number of times of use of the embroidery data of the specified embroidery pattern, and the judging means judges whether the embroidery data of the specified embroidery pattern has unfairly been used, on the basis of the number of times of use counted by the count means.

* * * * *